United States Patent [19]

Steinemer

[11] Patent Number: 4,593,165

[45] Date of Patent: Jun. 3, 1986

[54] VACUUM SWITCH

[75] Inventor: Norbert Steinemer, Berlin, Fed. Rep. of Germany

[73] Assignee: Siemens Aktiengesellschaft, Munich, Fed. Rep. of Germany

[21] Appl. No.: 722,138

[22] Filed: Apr. 11, 1985

[30] Foreign Application Priority Data

Apr. 12, 1984 [DE] Fed. Rep. of Germany ..... 3414016

[51] Int. Cl.[4] ..... H01H 33/66

[52] U.S. Cl. ..... 200/144 B; 200/148 F

[58] Field of Search ..... 200/144 B, 148 R, 148 F

[56] References Cited

U.S. PATENT DOCUMENTS 3,471,669 10/1969 Curtis ..... 200/144 B
3,562,457 2/1971 Peek ..... 200/144 B
3,582,587 6/1971 Barkan .
4,099,039 7/1978 Barkan .
4,323,871 4/1982 Kamp et al. .

FOREIGN PATENT DOCUMENTS 3020800 12/1981 Fed. Rep. of Germany ... 200/144 B
1126362 9/1968 United Kingdom .

*Primary Examiner*—Robert S. Macon
*Attorney, Agent, or Firm*—Kenyon & Kenyon

[57] ABSTRACT

A vacuum switch with a driving device for switching a vacuum-tight switching tube into on and off positions. The vacuum switch includes a movable connecting pin, a drive lever, a spring, and a stop. The spring is connected between the connecting pin and the drive lever. The engagement of the spring and the stop with the drive lever yields lever arms of different lengths. The relative dimensions of the lever arms are such that when the switching tube is in the off position, an opening force cancels a switching-on closing force.

8 Claims, 7 Drawing Figures

VACUUM SWITCH

BACKGROUND OF THE INVENTION

The invention relates to a vacuum switch with a driving device for switching a vacuum-tight switching tube into on and off positions. The vacuum switch includes a spring that is connected between (1) a movable connecting pin of the switching tube and (2) a drive lever of the driving device. The drive lever can rotate about a pivot bearing. When the connecting pin is moving in a switching-off direction, a stop limits the relative motion between the connecting pin and the drive lever.

An example of a known vacuum switch is disclosed in U.S. Pat. No. 4,099,039, issued on July 4, 1978. As disclosed therein, the spring engaging the connecting pin of the vacuum switching tube serves as a contact pressure spring. During the switching-on process of the vacuum switch, the driving device supplies all of the forces that are required for moving the elements involved in the switching operation. In the switching-on process, the driving device overcomes tne pre-tensioning forces of the contact pressure spring so as to generate the necessary contact pressure between the cooperating contacts of the switohing tube. Once the vacuum switch has been switched on, the driving device is latched.

In order to switch the vacuum switch off, a separate switching-off power accumulator is discharged. The contact pressure spring aids the switching-off process up to the metallic separation of the contacts.

In multi-pole switchgear, power accumulators for switching on and off are generally provided, the power accumulators being common for all switching tubes. The power accumulators act via a switching shaft common to the poles or the switching tubes. Each switching tube requires, however, a separate contact pressure spring. Thus, a three-pole switch has at least five springs: namely, a switching-on spring, a switching-off spring, and three contact pressure springs. Of these five springs, the switching-on spring and the switching-off spring are generally contained in an actuator box, wherein the contact pressure springs are arranged in the vicinity of each switching tube or in line with the drive rod belonging to each switching tube.

SUMMARY OF THE INVENTION

It is an object of the present invention to reduce the amount of technical means for the above-described extensive spring arrangement for vacuum switches and, at the same time, to improve the operation of vacuum switches. Accordingly, the present invention includes in a vacuum switch a stop connected to a connecting pin. A spring and the stop engage a drive lever, yielding lever arms of different lengths as measured from the drive lever's pivot. The lever arm associated with the spring is designed to be larger than the lever arm associated with the stop, and the relative lengths of the lever arms are chosen so that in the "off" position, an opening force acting on the connecting pin cancels a switching-on closing force that is caused by ambient air pressure acting with respect to the connecting pin and a vacuum-tight switching tube. In this arrangement, the spring takes over the tasks of both a contact pressure spring and a switching-off spring. The switching-off spring that was required heretofore (and common to several switching tubes) can therefore be omitted. The result is simplification and a size reduction of the actuator box.

A further advantageous property of the instant new spring arrangement is that the change in direction of the load that always occurred between each switching tube and the drive in known driving devices is eliminated. The reason for said elimination is that the drive linkage is always stressed in the same direction, and, therefore, tolerances in bearings and joints cannot have the effect of backlash. This results in the elimination of a range of indifferent contact (indifferent contact being when the contacts touch each other without contact pressure, wherein the contacts can weld together).

The invention disclosed herein in its different embodiments achieves the above and other objects.

In one embodiment of the invention disclosed herein, the switching tube of the vacuum switch is provided with an extension piece coupled to the connecting pin. A pivot bearing of a drive lever is positioned laterally to the extension piece. The drive lever has a length extending beyond a stop attached to the extension section. The drive lever is provided at its end with an abutment for one end of a spring. The spring is designed as a tension spring or a compression spring. The other end of the spring is connected to an abutment located at the free end of the extension piece.

In another embodiment of the invention disclosed herein, the drive lever has an arm that extends approximately transversely to the extension piece and cooperates with the stop attached to the extension section. The drive lever has a second arm that extends approximately transversely to the extension section. The second arm extends beyond the extension section and forms an abutment for one end of a spring designed as a compression spring. The other end of the spring is coupled to an abutment at the free end of the extension section.

Thus, the present invention can be implemented with either a compression spring or a tension spring. The choice of which spring is more advantageous depends upon the required spring characteristic, the space available, and other similar practical considerations.

Contact pressure as well as an opening force is generated at each switching tube by either a tension spring or a compression spring. The present invention thus results in the elimination of an additional common opening spring for switching tubes, yielding a simplified structure.

The lever arrangement of the present invention also works without change of load direction. Therefore, there is no backlash in the drive, and for all practical purposes, there is no region of indifferent contact in which the contact pressure is approximately zero. Thus the danger of welding of contacts is reduced.

In implementing the present invention, new parts are generally not required. Rather, said implementation only requires the redesign of parts already existing.

The above and other objects, aspects, features, and advantages of the invention will be more readily perceived from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts, and in which.

DESCRIPTION OF THE INVENTION

Figure 1:
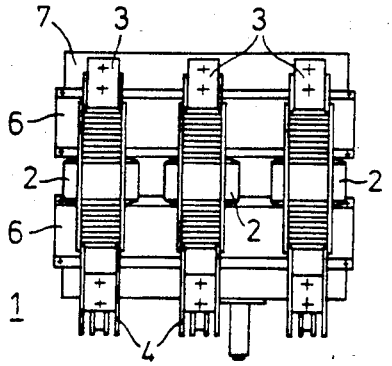
FIG. 1 is a front view of a three-pole vacuum switch showing switching tubes arranged side by side.

Referring now to the drawings, embodiments of a vacuum switch with a driving device and components thereof according to the invention are illustrated.

FIG. 1 shows a vacuum switch 1 that is a three-pole circuit-breaker for a medium-voltage range. In FIG. 1, three switching tubes 2 are arranged parallel to each other. They are each arranged between a head-piece 3 and a drive base 4.

Figure 2:
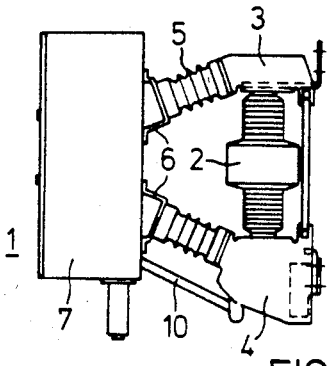
FIG. 2 is a side view of the vacuum switch shown in FIG. 1.

FIG. 2 shows a side view of the vacuum switch 1. FIG. 2 shows that each switching tube 2 is fastened to support channels 6 by means of pin-type insulators 5. The channels 6 are mounted parallel to each other in a drive box 7. The drive base 4 associated with each switching tube 2 contains a driving arrangement that will be described in detail with the aid of FIGS. 3 to 5. The drive base 4 is connected by a coupling rod 10 to the parts of the drive that are contained in the drive box 7 and that are common to all three poles of circuit-breaker 1.

Figure 3:
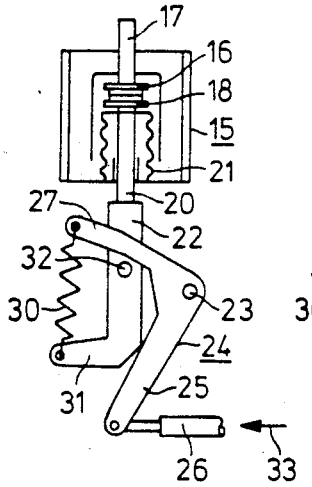
FIGS. 3, 4, and 5 show details of the drive of a switching tube in different switch positions, the embodiment of the invention shown in FIGS. 3, 4, and 5 incorporating a tension spring.
Figure 4:
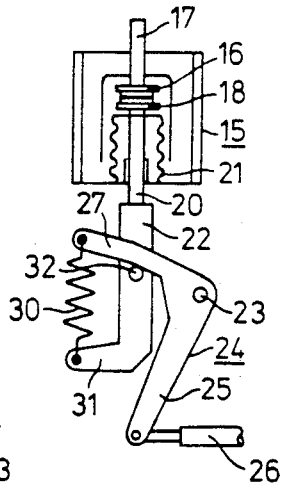
Figure 5:
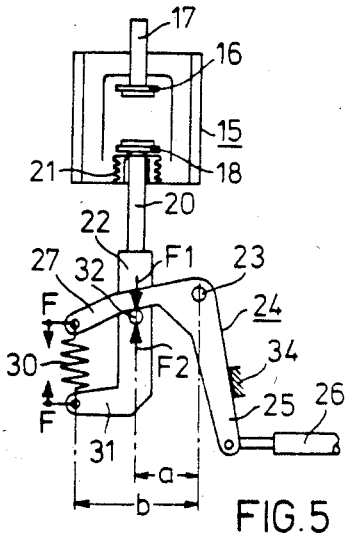

FIGS. 3, 4 and 5, each show a switching tube 15 schematically in cross section. The switching tube 15 has a stationary contact 16 with a connecting pin 17 that is clamped in a stationary manner, not shown in detail. For example, the clamping can be by means of a head-piece 3 shown in FIGS. 1 and 2. A movable contact 18 cooperates with the contact 16.

Connecting pin 20, of the movable contact 18, is brought out of the housing of the switching tube in a known manner. The switching tube 15 is kept vacuum-tight by means of bellows 21.

Connected to connecting pin 20 is an extension piece 22 that extends substantially in the longitudinal direction of the contact arrangement of the switching tube 15. Laterally of the extension piece 22 there is a pivot bearing 23, formed by a pin. Pivot bearing 23 is coupled to a drive lever 24.

Drive lever 24 has an arm 25 of which a coupling rod 26 is linked. Coupling rod 26 corresponds to connecting rod 10 of FIGS. 1 and 2. Coupling rod 26 of FIGS. 3–5 and connecting rod 10 of FIGS. 1 and 2 transmit the switch closing force. Drive lever 24 has a second arm 27 that is approximately perpendicular to arm 25. Arm 27 extends toward the side of the longitudinal axis of extension piece 22 that is opposite to the side containing pivot bearing 23. The end of arm 27 is designed as an abutment for a tension spring 30.

One end of tension spring 30 thus engages the drive lever 24. The other end of the tension spring engages an angled-off portion 31 of the extension section 22. Angled-off portion 31 extends toward the side opposite the support pin 23 with respect to the longitudinal axis of the extension section 22.

The extension piece 22 is provided with a stop 32 for the lever arm 27 of the drive lever 24. The stop 32 is designed as a pin.

In FIG. 3, an embodiment of the present invention is shown in a closed condition. The closed condition is brought about by the coupling rod 26 being moved in the direction of arrow 33 by means of a driving device, not shown. The drive lever 24 is thereby swung clockwise about pin 23. As a result, the tension spring 30 is tensioned, transmitting its tension force to the movable connecting pin 20 by way of the extension piece 22. In the closed position, the arm 27 of the drive lever is lifted off of stop 32. As is further described herein, the tension spring 30 determines the contact pressure occurring between the contacts 16 and 18. The coupling rod 26 is locked into the switch "on" position by a known mechanism that is customary in switchgear and therefore not shown.

FIG. 4 shows the switching-off of an embodiment of the present invention. For switching-off the switching tube 15, the locking of the coupling rod 26 is released. The drive lever 24 then swings counterclockwise under the influence of tension spring 30. The contacts 16 and 18 initially remain in contact with each other. The contact condition is maintained until the arm 27 of the drive lever 24 hits stop 32 of the extension piece 22. A further counterclockwise swing of drive lever 24 causes connecting pin 20 to move in the switching-off direction.

The embodiment of the invention thereby arrives at the end position shown in FIG. 5. In FIG. 5, the contacts 16 and 18 are fully open and the spring 30 is at its shortest length. In the position shown in FIG. 5, the drive lever 24 rests with its arm 25 against a stop 34.

FIG. 5 illustrates lever arms "a" and "b". For bringing about the opening motion of the switch, the ratio of the effective lever arms "a" and "b" is the governing factor. The lever arm of the leg 27 of the drive lever 24 with respect to the stop 32 is designated as lever arm "a". The lever arm of the leg 27 of the drive lever 24 with respect to the abutment of the tension spring 30 is designated as lever arm "b".

In the switch opening position shown in FIG. 5, the force of the tension spring 30 is designated by an "F". Tension spring 30 creates a force F1 that acts in the direction of opening of the switching tube 15. Force F1 corresponds to the spring force F enlarged by the ratio b/a of the lever arms. Force F1 acts at the extension section 22 where the leg 27 of the drive lever 24 rests against stop 32. Opening force F1 is reduced, however, by force F2, force F2 being equal to the spring force F. There also exists a closing force (not shown) caused by ambient air pressure. As can be seen by the relationship of forces set forth above, the closing force can be overcome by choosing force F1 to be sufficiently larger than force F2. Said choice is achieved by a suitable choice of spring force F and lever arms "a" and "b".

As shown by FIGS. 3–5, the spring 30 serves as both a contact pressure spring and an opening spring. Spring 30 thus replaces the customary opening spring known heretofore, which was common to several poles of a switchgear.

In the switch positions shown in FIGS. 3 and 4, the lever arm ratio "b/a" is not yet effective. In FIG. 3, leg 27 is not yet in contact with the step 32 and no force is therefore being transmitted. As a result, the contact force in the switch "on" position (shown in FIG. 3) is approximately equal to the force of the cocked tension spring 30. In FIG. 4, the contact force likewise corresponds to the spring force of tension spring 30. The contact force in FIG. 4 is less than the contact force in FIG. 3, however, because the tension of the tension spring 30 is reduced in FIG. 4.

Figure 6:
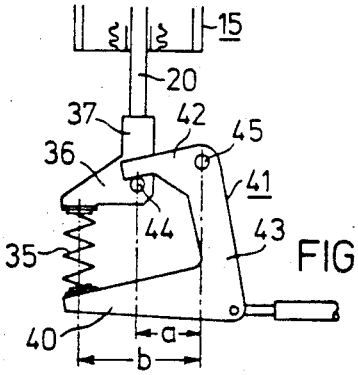
FIG. 6 shows an embodiment of the invention with a compression spring.

FIG. 6 shows another embodiment of the present invention. In FIG. 6, a compression spring 35 is provided instead of the tension spring 30 shown in FIGS. 3–5. Compression spring 35 has one end braced against an angled-off part 36 of an extension piece 37. That end of the compression spring 35 is mounted similarly to the tension spring 30 of FIGS. 3–5. Extension piece 37 of FIG. 6 is shaped differently than extension piece 22 of FIGS. 3–5. The opposite end of compression spring 35 of FIG. 6 rests against an additional leg 40 of a drive lever 41. A pivot bearing 45 of the drive lever 41 is similar to the pivot bearing 23 of FIGS. 3–5. Pivot bearing 45 of FIG. 6 is located approximately at the intersection of legs 42 and 43 of drive lever 41.

The upper leg 42 of drive lever 41 is long enough to come into contact with a stop 44 of the extension piece 37, but the upper leg 42 does not extend much beyond that contact point.

The operation of the embodiment of the present invention shown in FIG. 6 is logically the same as the operation described in connection with the embodiment shown in FIGS. 3–5. This similarity of operation is due to lever arms "a" and "b" shown in FIG. 6. The engagement of spring 35 with leg 40 of the drive lever 41 yields lever arm "b" with respect to pivot bearing 45. The engagement of upper leg 42 with the stop 44 yields lever arm "a" (with respect to pivot bearing 45), which is shorter than lever arm "b".

Figure 7:
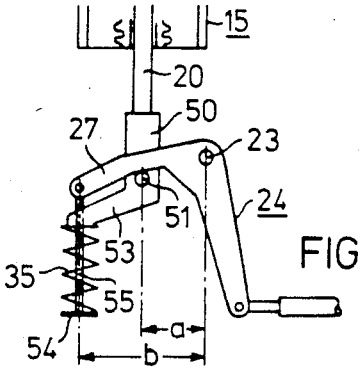
FIG. 7 shows an embodiment of the invention with a compression spring, a cup spring, and a tie rod linking the drive lever to the extension piece.

FIG. 7 shows an embodiment of the present invention with a compression spring 35, corresponding to the spring shown in FIG. 6, and a drive lever 24, corresponding to the drive lever shown in FIGS. 3–5. The embodiment of FIG. 7 differs from the embodiment of FIG. 6, however. Extension piece 50 has an angled-off portion 53 that extends slightly below a stop 51. The extension piece 50 extends on the side of the longitudinal axis of the connecting pin 20 that is opposite to the side containing a pivot bearing 23 of the drive lever 24.

In FIG. 7, one end of compression spring 35 is braced against the angled-off portion 53. This is similar to the mounting shown in FIG. 6 of the same end. In FIG. 7, however, the other end of compression spring 35 is braced against a cup spring 54. Cup spring 54 is located at the lower end of a tie rod 55, tie rod 55 being linked to the end of leg 27 of drive lever 24.

The operation of the embodiment of the invention shown in FIG. 7 agrees with the operation explained in connection with FIGS. 3–6 because the embodiment of FIG. 7 includes lever arms "a" and "b", similar to the lever arms described in connection with FIGS. 3–6.

Certain changes and modifications of embodiments of the invention disclosed herein will be apparent to those skilled in the art. Applicant intends to cover by his claims all those changes and modifications that could be made to the embodiments herein, chosen for the purposes of disclosure, without departing from the spirit and scope of the invention.

What is claimed is:

1. A vacuum switch with a driving device for switching a vacuum-tight switching tube into on and off positions, the vacuum switch including a movable connecting pin of the switching tube;

a drive lever of the driving device, the drive lever coupled to a pivot bearing so as to allow the drive lever to swing about the pivot bearing;

a spring having two ends, one end being connected to the connecting pin, the other end being connected to the drive lever;

a stop for limiting the relative motion, in a switching-off direction, of the connecting pin and the drive lever, wherein the improvement comprises:

the stop being connected to the connecting pin;

an engagement of the spring and the stop with the drive lever yielding lever arms of different lengths as measured from the pivot bearing, the engagement yielding a first lever arm measured from the pivot bearing to the stop, and the engagement yielding a second lever arm measured from the pivot bearing to a point of connection of the spring and the drive lever;

the second lever arm being longer than the first lever arm, and the relative dimensions of the first and second lever arms being such that when the switching tube is in the off position, an opening force, which acts upon the connecting pin, cancels a switching-on closing force, which acts upon the connecting pin and which is caused by ambient air pressure.

2. A vacuum switch as recited in claim 1, in which the spring is a tension spring.

3. A vacuum switch as recited in claim 1, in which the spring is a compression spring.

4. A vacuum switch with a driving device for switching a vacuum-tight switching tube into on and off positions, the vacuum switch including a movable connecting pin of the switching tube;

an extension piece coupled to the connecting pin;

a pivot bearing disposed laterally with respect to the extension piece;

a drive lever of the driving device, the drive lever coupled to the pivot bearing so as to allow the drive lever to swing about the pivot bearing;

a spring having two ends;

a stop for limiting the relative motion, in a switching-off direction, of the extension piece and the drive lever, wherein the improvement comprises:

the stop being attached to the extension piece;

the drive lever having a leg that extends beyond a point where the stop engages the drive lever, the leg being provided at its end with an abutment;

the extension piece having an abutment at the end of the extension piece;

one end of the spring being connected to the abutment of the leg of the drive lever, the other end of the spring being connected to the abutment of the extension piece;

an engagement of the spring and the stop with the drive lever yielding lever arms of different lengths as measured from the pivot bearing, the engagement yielding a first lever arm measured from the pivot bearing to the stop, and the engagement yielding a second lever arm measured from the pivot bearing to a point of connection of the spring and the abutment of the drive lever;

the second lever arm being longer than the first lever arm, and the relative dimensions of the first and second lever arms being such that when the switching tube is in the off position, an opening force, which acts upon the connecting pin and the extension piece, cancels a switching-on closing force, which acts upon the connecting pin and the extension piece, and which is caused by ambient air pressure.

5. A vacuum switch as recited in claim 4, in which the spring is a tension spring.

6. A vacuum switch with a driving device for switching a vacuum-tight switching tube into on and off positions, the vacuum switch including a movable connecting pin of the switching tube;

an extension piece coupled to the connecting pin;

a pivot bearing disposed laterally with respect to the extension piece;

a drive lever of the driving device, the drive lever coupled to the pivot bearing so as to allow the drive lever to swing about the pivot bearing;

a spring having two ends, one end being connected to the extension piece, the other end being connected to the drive lever;

a stop for limiting the relative motion, in a switching-off direction, of the extension piece and the drive lever, wherein the improvement comprises:

the stop being attached to the extension piece;

the drive lever having a lower leg that extends approximately transversely to the direction of motion of the extension piece, the lower leg being provided at its end with an abutment;

the drive lever having an upper leg that extends approximately transversely to the direction of motion of the extension piece, the upper leg capable of engaging the stop;

the extension piece having an abutment at the end of the extension piece;

one end of the spring being connected to the abutment of the lower leg of the drive lever, the other end of the spring being connected to the abutment of the extension piece;

an engagement of the spring and the stop with the upper leg of the drive lever yielding lever arms of different lengths as measured from the pivot bearing, the engagement yielding a first lever arm measured from the pivot bearing to the stop, and the engagement yielding a second lever arm measured from the pivot bearing to a point of connection of the spring and the abutment of the extension piece;

the second lever arm being larger than the first lever arm, and the relative dimensions of the first and second lever arms being such that when the switching tube is in the off position, an opening force, which acts upon the connecting pin and the extension piece, cancels a switching-on closing force, which acts upon the connecting pin and the extension piece, and which is caused by ambient air pressure.

7. A vacuum switch as recited in claim 6, in which the spring is a compression spring.

8. A vacuum switch with a driving device for switching a vacuum-tight switching tube into on and off positions, the vacuum switch including a movable connecting pin of the switching tube;

an extension piece coupled to the connecting pin;

a pivot bearing disposed laterally with respect to the extension piece;

a drive lever of the driving device, the drive lever coupled to the pivot bearing so as to allow the drive lever to swing about the pivot bearing;

a spring having two ends;

a stop for limiting the relative motion, in a switching-off direction, of the extension piece and the drive lever, wherein the improvement comprises:

the stop being attached to the extension piece;

the drive lever having a leg that extends beyond a point where the stop engages the drive lever, the leg being provided with an abutment;

the extension piece having an abutment at the end of the extension piece;

a cup spring;

one end of the spring being connected to the abutment of the leg of the drive lever, the other end of the spring engaging the cup spring;

a tie rod, one end of which is connected to the cup spring, the other end of which is connected to the abutment of the extension piece;

an engagement of the spring and the stop with the drive lever yielding lever arms of different lengths as measured from the pivot bearing, the engagement yielding a first lever arm measured from the pivot bearing to the stop, and the engagement yielding a second lever arm measured from the pivot bearing to a point of connection of the tie rod and the abutment of the drive lever;

the second lever arm being longer than the first lever arm, and the relative dimensions of the first and second lever arms being such that when the switching tube is in the off position, an opening force, which acts upon the connecting pin and the extension piece, cancels a switching-on closing force, which acts upon the connecting pin and the extension piece, and which is caused by ambient air pressure.

* * * * *